US007571809B2

(12) United States Patent
Yahiel

(10) Patent No.: US 7,571,809 B2
(45) Date of Patent: Aug. 11, 2009

(54) PACKAGE AND METHOD FOR PERSONALIZING A PRODUCT IN A CONTAINER

(76) Inventor: Tammy A. Yahiel, 4240 Windhaven La., Dallas, TX (US) 75287

( * ) Notice: Subject to any disclaimer, the term of this patent is extended or adjusted under 35 U.S.C. 154(b) by 563 days.

(21) Appl. No.: 11/264,329

(22) Filed: Nov. 1, 2005

(65) Prior Publication Data

US 2007/0095707 A1 May 3, 2007

(51) Int. Cl.
*B65D 85/00* (2006.01)

(52) U.S. Cl. ..... 206/459.5; 206/427; 206/232

(58) Field of Classification Search ..... 206/459.5, 206/497, 427, 232, 223; 40/310, 306; 283/81, 283/101; 705/26, 27
See application file for complete search history.

(56) References Cited

U.S. PATENT DOCUMENTS

| | | | | |
|---|---|---|---|---|
| 4,475,653 | A * | 10/1984 | Ullman | 206/497 |
| 4,609,101 | A * | 9/1986 | Ullman | 206/432 |
| 4,700,528 | A * | 10/1987 | Bernard | 53/398 |
| 4,730,730 | A * | 3/1988 | Clarkson | 206/497 |
| 5,704,144 | A | 1/1998 | Groth | 40/306 |
| 6,086,702 | A | 7/2000 | Rea | 156/247 |
| 6,171,260 | B1 * | 1/2001 | Hochmeister et al. | 600/572 |
| 6,176,836 | B1 * | 1/2001 | Trudil et al. | 600/572 |
| 6,522,945 | B2 | 2/2003 | Sleep et al. | 700/225 |
| 6,594,927 | B2 * | 7/2003 | Witkowski | 40/310 |
| 6,821,371 | B1 | 11/2004 | Liu | 156/221 |
| 6,845,365 | B2 * | 1/2005 | von Rosen et al. | 705/27 |
| 6,964,343 | B2 * | 11/2005 | Tilly | 211/74 |
| 2002/0161464 | A1 | 10/2002 | Weiner | 700/97 |
| 2003/0061217 | A1 | 3/2003 | Whittingham et al. | 707/10 |
| 2004/0129712 | A1 | 7/2004 | Egan | 220/592.16 |
| 2005/0038558 | A1 | 2/2005 | Keene | 700/235 |

OTHER PUBLICATIONS

Premier Label Water Company (PLWC), "Build Your Own Proprietary Bottle Online!," http://www.plwc.net/build_bottle.html, 4 pages.
MacDay Label Systems, "Custom Labels for your everyday wines," http://www.macday.ca/, 3 pages.
Premier Label Water Company (PLWC), "Build Your Own Proprietary Bottle Online!," http://www.plwc.net/build_bottle.html, 4 pages, 2004.
MacDay Label Systems, "Custom Labels for your everyday wines," http://www.macday.ca/, 3 pages, 2001.

* cited by examiner

*Primary Examiner*—David T Fidei
(74) *Attorney, Agent, or Firm*—Baker Botts L.L.P.

(57) ABSTRACT

A single package for personalizing a product in a container includes a plurality of containers. Each container has a volume to hold a product and an exterior surface. The exterior surface of each container is unlabeled. A label kit provides for labeling the containers, and an enclosure holds the containers and the label kit in a single package.

6 Claims, 2 Drawing Sheets

PACKAGE AND METHOD FOR PERSONALIZING A PRODUCT IN A CONTAINER

TECHNICAL FIELD OF THE INVENTION

This invention relates generally to the field of containers and more specifically to a package and method for personalizing a product in a container.

BACKGROUND

Food, beverages, candy, shampoo, conditioner, and other items are packaged in containers that include labels to provide source identification of the item. A user may desire to personalize the label on the item for a special event, for publicity, or for a variety of reasons instead of providing the general source identification. Conventionally, the user purchases the labeled item and replaces the label, or hires a third party to make the personalized item.

SUMMARY OF THE DISCLOSURE

In accordance with the present invention, disadvantages and problems associated with personalizing a product in a container may be reduced or eliminated.

According to one embodiment of the present invention, a single package for personalizing a product in a container includes a plurality of containers. Each container has a volume to hold a product and an exterior surface. The exterior surface of each container is unlabeled. A label kit provides for labeling the containers, and an enclosure surrounds the containers and the label kit in a single package.

In another embodiment of the present invention, personalizing a product in a container includes acquiring a single package comprising a plurality of containers and a label kit surrounded by an enclosure. Each container has a volume to hold a product and an exterior surface. The exterior surface of each container is unlabeled. The instructions provided in the label kit are followed to personalize each container.

Certain embodiments of the invention may provide one or more technical advantages. A technical advantage of one embodiment includes allowing a user to acquire unlabeled containers and personalize the containers without involving a third party. Additionally, the user does not have to remove a source identification label, but can acquire unlabeled containers. Another technical advantage provides the user with the necessary supplies to personalize the containers in a single package. The single package includes instructions that provide a website address or software to generate labels to personalize the containers. Therefore, the user does not have to compile the supplies from different sources to create the personalized container.

Certain embodiments of the invention may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION OF THE DRAWINGS

Embodiments of the present invention and its advantages are best understood by referring to FIGS. 1 through 4, like numerals being used for like and corresponding parts of the various drawings.

Figure 1:
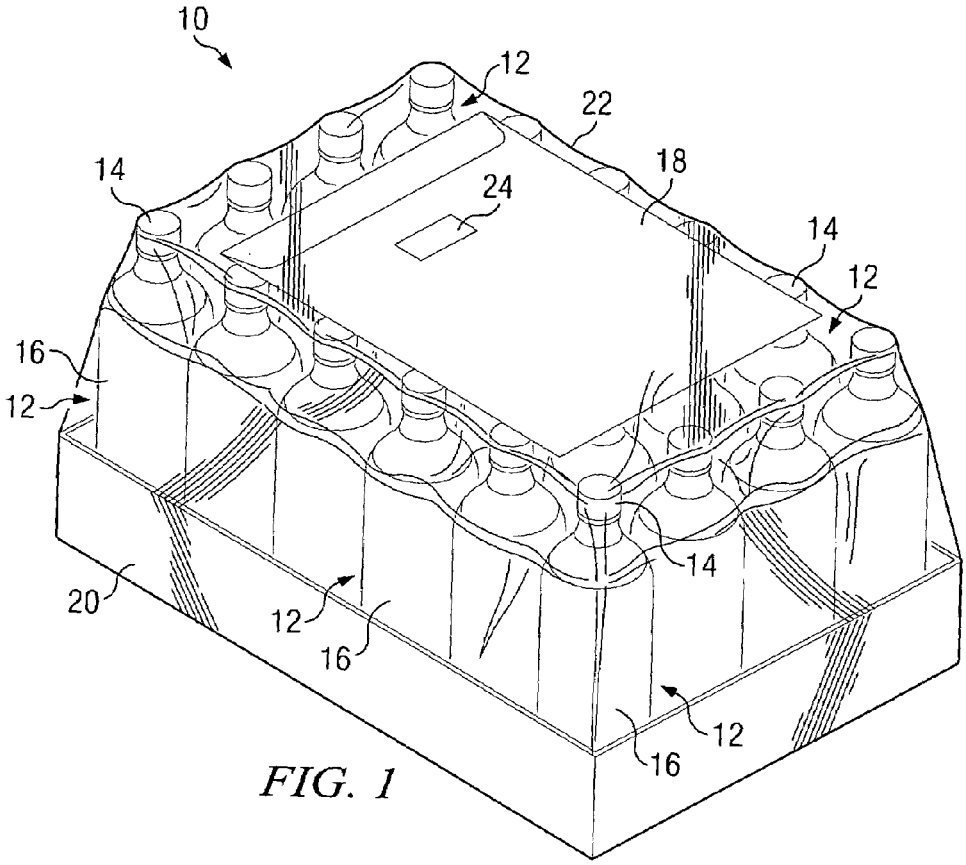
FIG. 1 illustrates a single package including containers, a label kit, and a case.

FIG. 1 illustrates a single package 10 including containers 12, a label kit 18, and a case 20. Case 20 houses containers 12 and label kit 18 to provide a single package 10 to personalize unlabeled container 12 using labels.

In addition to containers 12, label kit 18, and case 20, package 10 may include other suitable objects for personalizing container 12. For example, package 10 includes a ink cartridge 24 to facilitate printing labels to personalize container 12.

Container 12 may include any suitable container, such as a bottle, a can, a box, or a bag. Container 12 is made of plastic, glass, metal, cardboard, or any other suitable material. In the illustrated embodiment, container 12 is a disposable, plastic bottle. The various materials also provide for recycling container 12 or reusing container 12. Container 12 may be any suitable dimension. In an embodiment, containers 12 are of a dimension to allow case 20 to accommodate multiple containers 12. For example, if each container 12 is a square with a dimension of two inches by two inches, case 20, having a dimension of ten inches by ten inches, can hold twenty-five containers 12. The height, diameter, and capacity of container 12 may be altered as needed. Container 12 may be any suitable shape, such as a circle, an oval, or a square, that has a volume to accommodate a substance.

Container 12 includes a volume that accommodates any suitable product, such as water, juice, soda, or food. Container 12 may include the product or may be empty when a user gets case 20. Container 12 may include any suitable closure 14 that attaches to container 12 and prevents the product from escaping container 12. For example, a user can transport containers 12 without spilling or wasting the product when closure 14 attaches to container 12. Closure 14 may be a screw-on cap, a metal lid, or any suitable closure.

Container 12 includes an exterior surface 16 that allows a user to personalize container 12. In an embodiment, exterior surface 16 is blank and unlabeled. In another embodiment, container 12 includes a suitable identification to comply with applicable regulations and an unlabeled exterior surface 16 for personalization. Exterior surface 16 receives a label, tape, paper, or any suitable item that provides for the personalization of container 12.

Package 10 includes a label kit 18 that holds the suitable supplies for a user to personalize containers 12. Label kit 18 may be an envelope that holds the supplies, a small box, or any suitable kit. In the illustrated embodiment, label kit 18 is positioned on top of closures 14. Label kit 18 may also be positioned below containers 12, on the side of case 20, or in any suitable position within package 10.

Case 20 includes containers 12 and label kit 18 in a single package 10. Case 20 is made of cardboard, wood, or any suitable material. Case 20 may be any suitable dimension to accommodate multiple containers 12 and label kit 18. The height, width, and depth of case 20 may be altered as needed. In the illustrated embodiment, case 20 includes sides that extend from the base of case 20. The sides allow containers 12 to remain inside case 20 during transport of package 10.

Enclosure 22 further provides for maintaining containers 12 and label kit 18 inside case 20. Enclosure 22 surrounds containers 12, label kit 18, and case 20. Enclosure 22 is any suitable material, such as plastic or cardboard, and can be placed around containers 12, label kit 18, and case 20 in any suitable manner. For example, enclosure 22 is vacuum sealed around containers 12, label kit 18, and case 20, or enclosure 22 is shrink-wrapped around containers 12, label kit 18, and case 20. As another example, package 10 includes multiple enclosures 22, such as a packing enclosure and a shipping enclosure.

Modification, additions, or omissions may be made to package 10 without departing from the scope of the invention. For example, case 20 may fully enclose containers 12 and label kit 18 without using enclosure 22. As another example, case 20 may include any suitable number of containers 12 for a user to personalize.

Figure 2:
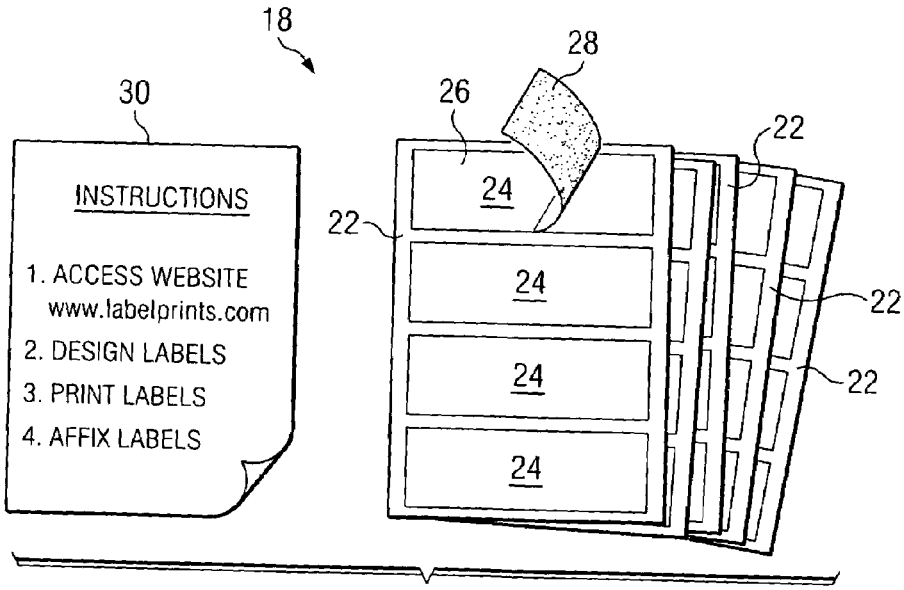
FIG. 2 illustrates contents of the label kit.

FIG. 2 illustrates contents of label kit 18. In an embodiment, label kit 18 includes sheets 22. Each sheet 22 includes blank labels 24 to place on containers 12. Each sheet 22 may include any suitable number of labels 24, and label kit 18 may include any suitable number of sheets 22. In an embodiment, the number of labels 24 on sheets 22 equals the number of containers 12 in case 20. For example, if case 20 includes twenty-five containers 12, label kit 18 includes five sheets 22 that have five labels 24 on each sheet. In this example, the number of labels 24 provided in label kit 18 equals the number of containers 12. As another example, label kit 18 may include extra labels 24. If case 20 includes twenty-five containers 12 and label kit 18 includes six sheets 22 that have five labels 24 on each sheet, there is a total of thirty labels 24. Therefore, the user has five extra labels 24. As yet another example, a user may select the number and/or characteristics of labels 24 to include within label kit 18.

Labels 24 include a non-adhesive surface 26 and an adhesive surface 28. Non-adhesive surface 26 of label 24 receives the design the user creates. Non-adhesive surface 26 faces outward from exterior surface 16 of container 12 and remains visible. Adhesive surface 28 adheres to exterior surface 16 of container 12 to cause label 24 to remain fixed to container 12. Adhesive surface 28 may include any suitable adhesive to cause label 24 to adhere to exterior surface 16 of container 12. For example, adhesive surface 28 includes glue, tape, or a magnetic surface to facilitate adherence. Label 24 may be of any suitable size, shape, color, or other suitable characteristic. As another example, label kit 18 includes labels 24 having different characteristics. Label kit 18 may have circular-shaped labels 24 and square-shaped labels 24 within the same label kit 18.

In the illustrated embodiment, label kit 18 also includes instructions 30 that inform the user about personalizing containers 12. Instructions 30 may include any suitable information regarding designing labels 24 and personalizing containers 12. For example, instructions 30 may include a username with an optional password to access the website. As another example, instructions 30 in label kit 18 may have a username linked to the type, size, and/or number of containers 12 in case 20. Therefore, various containers 12 correspond to different usernames that the website recognizes when the username is entered at the website. As yet another example, the username is linked to pre-designed labels 24. Additionally, the username may be linked to predetermined product information. The predetermined product information may include information regarding the type and/or dimension of container 12, the dimension of label 24, or an event or theme associated with the particular product, or any other suitable information. In this example, a user enters the username and accesses a prepared label 24 that the user prints and affixes to container 12. Prepared label 24 includes a design, text, or any suitable information that is based on the predetermined product information. In the illustrated embodiment, instructions 30 include a website address that a user accesses to design labels 24.

Modifications, additions, or omissions may be made to the contents of label kit 18. For example, label kit 18 may include additional material, such as brochures, flyers, promotional materials, or software.

Figure 3A:
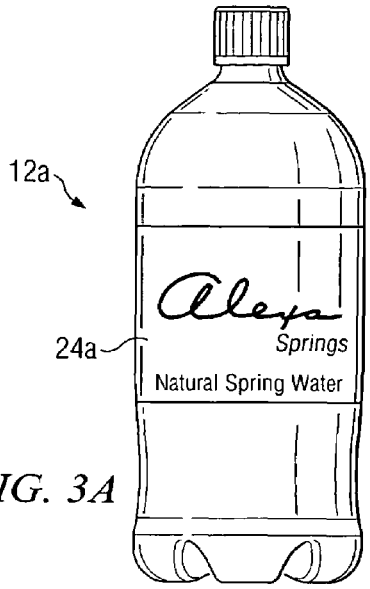
FIG. 3 illustrates a container with a source-identification label and a container with a personalized label.
Figure 3B:
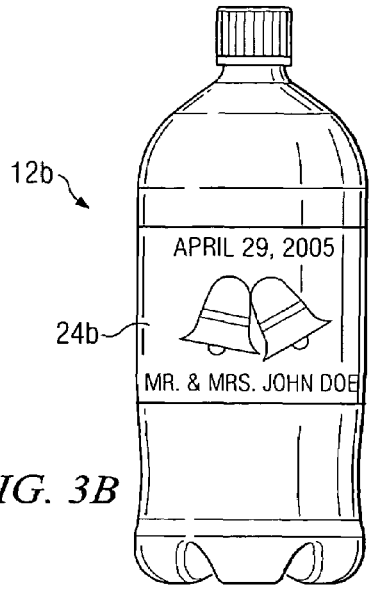

FIG. 3 illustrates container 12*a* with source identification label 24*a* and container 12*b* with personalized label 24*b*. Container 12*b* provides an example of how a user personalizes label 24*b*. The user accesses the website address on instructions 30 and designs personalized label 24*b*. In an embodiment, the user selects a pre-configured design or a template based on a holiday, an event type, or any suitable theme and provides information on the website to further personalize label 24*b*. In the illustrated embodiment, the event type is a wedding. Therefore, a prepared design is printed onto label 24*b* based on the event type in addition to user-inputted information, such as a date and names. As another example, the user designs personalized label 24*b* without using a pre-configured template or a prepared design.

Figure 4:
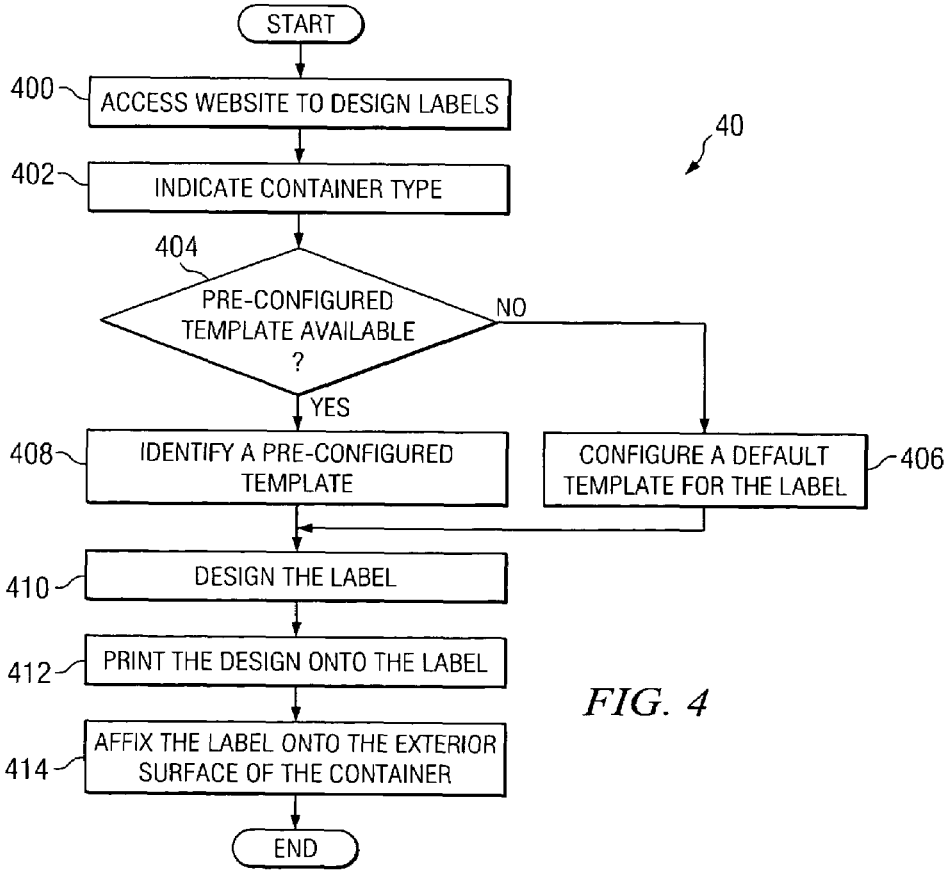
FIG. 4 is a flowchart for personalizing an unlabeled container using a label.

FIG. 4 is a flowchart 40 for personalizing an unlabeled container 12 using label 24. A user accesses the website address provided on instructions 30 to design labels 24 at step 400. The website address may require the user to enter a login and password, or the website may allow the user to design labels 24 without inputting any user information. When a user accesses the website, the user may conduct any suitable action to design labels 24. In another embodiment, a user loads software provided in label kit 18 onto a computer, and accesses the software to design labels 24. At step 402, the user indicates the type of containers 12. For example, the website may include a drop-down list of the various types of containers 12 available, and the user indicates the particular type of containers 12 in case 20. At step 404, the user determines whether a pre-configured template is available. The size of the pre-configured template equals the size of label 24. If the website does not provide a pre-configured template or if the website does not have a pre-configured template that equals the size of label 24, the user configures a default template to equal the size of label 24 at step 406. If one or more pre-configured templates are available that match the size of label 24, the user identifies a pre-configured template at step 408 to use in the design process. The pre-configured template or the user configured template may equal the size of sheet 22, the number of labels 24 on sheet 22, and the size of labels 24, or may fit the size of a single label 24.

At step 410, the user designs label 24. The design may include any suitable design, such as a pre-configured design provided on the website or a uniquely created design. The design is printed onto non-adhesive surface 26 of label 24 at step 412. The user affixes adhesive surface 28 of label 24 onto exterior surface 16 of container 12 at step 414, which allows the design on label 24 to remain visible. Flowchart 40 provides for the personalization of an unlabeled container 12.

Although the present invention has been described with several embodiments, a myriad of changes, variations, alterations, transformations, and modifications may be suggested to one skilled in the art, and it is intended that the present invention encompass such changes, variations, alterations, transformations, and modifications as fall within the scope of the appended claims.

What is claimed is:

1. A single package for personalizing a product in a container, comprising:

a plurality of containers, each container having:

a volume to hold a product;

an exterior surface, wherein the exterior surface of each container is unlabeled;

a closure coupled to the container, wherein the closure is operable to contain the product inside the volume;

a label kit to provide for labeling the containers, wherein the label kit comprises:

a plurality of labels, wherein each label comprises an adhesive surface and a non-adhesive surface; and instructions that facilitate designing each label and personalizing each container with the designed label, wherein the instructions comprise:

an address to a website, the website facilitates designing the labels and printing a design onto the labels; and a username to log on to the website, the username associates with predetermined product information and a prepared label, wherein the prepared label is designed in accordance with the predetermined product information; and an enclosure to surround the containers and the label kit in a single package.

2. The package of claim 1, further comprising a case to hold the containers and the label kit, wherein the enclosure surrounds the case, the containers, and the label kit.

3. The package of claim 1, wherein a number of the labels in the label kit is equivalent to a number of the containers in the package.

4. The package of claim 1, wherein:

the adhesive surface of each label affixes to the exterior surface of each container; and the non-adhesive surface of each label receives a design to personalize each container.

5. The package of claim 1, wherein each container is a disposable beverage bottle, and the product inside the volume is water.

6. A single package for personalizing a disposable water bottle, comprising:

a plurality of disposable water bottles, each bottle having:

a volume to hold water;

a closure coupled to the container, wherein the closure is operable to contain the water inside the volume; and an exterior surface, wherein the exterior surface of each bottle is unlabeled;

a label kit to provide for labeling the bottles, wherein the label kit comprises:

a plurality of labels, wherein each label comprises an adhesive surface and a non-adhesive surface, wherein:

the adhesive surface of each label affixes to the exterior surface of each bottle; and the non-adhesive surface of each label receives a design to personalize each bottle; and instructions that facilitate designing each label and personalizing each bottle with the designed label, wherein the instructions comprise:

an address to a website, the website facilitates designing the labels and printing a design onto the labels; and a username to log on to the website, the username associates with predetermined product information and a prepared label, wherein the prepared label is designed in accordance with the predetermined product information;

a case to hold the bottles and the label kit; and an enclosure to surround the bottles, the label kit, and the case in a single package.

* * * * *